US011627788B2

(12) United States Patent
Kim

(10) Patent No.: US 11,627,788 B2
(45) Date of Patent: Apr. 18, 2023

(54) FREELY-TRANSFORMABLE MULTIPURPOSE CARRIER

(71) Applicant: Hyun Ok Kim, Seoul (KR)

(72) Inventor: Hyun Ok Kim, Seoul (KR)

( * ) Notice: Subject to any disclaimer, the term of this patent is extended or adjusted under 35 U.S.C. 154(b) by 260 days.

(21) Appl. No.: 17/266,357

(22) PCT Filed: Aug. 13, 2019

(86) PCT No.: PCT/KR2019/010310
§ 371 (c)(1),
(2) Date: Feb. 5, 2021

(87) PCT Pub. No.: WO2020/036416
PCT Pub. Date: Feb. 20, 2020

(65) Prior Publication Data

US 2021/0315337 A1 Oct. 14, 2021

(30) Foreign Application Priority Data

Aug. 14, 2018 (KR) ..... 10-2018-0094930

(51) Int. Cl.
*A45C 9/00* (2006.01)
*A47B 3/06* (2006.01)
(Continued)

(52) U.S. Cl.
CPC ..... *A45C 9/00* (2013.01); *A45C 5/03* (2013.01); *A45C 5/14* (2013.01); *A45C 13/02* (2013.01);
(Continued)

(58) Field of Classification Search
CPC .... A45C 9/00; A45C 5/03; A45C 5/14; A45C 13/02; A45C 13/262; A45C 15/00;
(Continued)

(56) References Cited

U.S. PATENT DOCUMENTS 5,941,352 A * 8/1999 Lee ..... A47B 3/10 280/37
D598,671 S * 8/2009 Gagnon, Jr. ..... D6/686
(Continued)

FOREIGN PATENT DOCUMENTS

JP 2003-061729 A 3/2003
KR 1984-0002535 U 6/1984
(Continued)

OTHER PUBLICATIONS

International Search Report dated Dec. 12, 2019 in corresponding International application No. PCT/KR2019/010310; 4 pages.

*Primary Examiner* — Tri M Mai
(74) *Attorney, Agent, or Firm* — Novick, Kim & Lee, PLLC; Byungwoong Park

(57) ABSTRACT

A freely-transformable multipurpose carrier bag. The freely-transformable multipurpose carrier bag can be conveniently moved in the form of a carrier bag both indoors and outdoors and irrespective of the size of a place, can be transformed into and used as a table having a chair, can expose a pre-embedded electronic device component to the outside if needed, so as to enable a user to enjoy various forms of entertainment such as watching TV, using a computer, playing a game, or singing along with music, and can also enable the user to perform a business task, so that the user can universally perform both work and play.

2 Claims, 8 Drawing Sheets

(51) Int. Cl.

| | |
|---|---|
| ***A45C 5/03*** | (2006.01) |
| ***A45C 5/14*** | (2006.01) |
| ***A45C 13/02*** | (2006.01) |
| ***A45C 13/26*** | (2006.01) |
| ***A45C 15/00*** | (2006.01) |
| ***A47B 3/10*** | (2006.01) |
| ***A47B 3/12*** | (2006.01) |
| ***A47B 3/14*** | (2006.01) |
| ***A47B 21/06*** | (2006.01) |
| ***H04R 1/02*** | (2006.01) |
| ***H04R 3/00*** | (2006.01) |
| ***A47B 21/03*** | (2006.01) |

(52) U.S. Cl.
CPC ..... *A45C 13/262* (2013.01); *A45C 15/00* (2013.01); *A47B 3/063* (2017.08); *A47B 3/10* (2013.01); *A47B 3/12* (2013.01); *A47B 3/14* (2013.01); *A47B 21/06* (2013.01); *H04R 1/028* (2013.01); *H04R 3/00* (2013.01); *A45C 2013/025* (2013.01); *A45C 2013/267* (2013.01); *A47B 21/0314* (2013.01); *A47B 2021/0335* (2013.01); *A47B 2021/066* (2013.01); *H04R 2420/07* (2013.01)

(58) Field of Classification Search
CPC ..... A45C 2013/025; A45C 2013/267; A47B 3/063; A47B 3/10; A47B 3/12; A47B 3/14; A47B 21/06; A47B 21/0314; A47B 2021/0335; H04R 1/028; H04R 2420/07; H04R 3/00
See application file for complete search history.

(56) References Cited

U.S. PATENT DOCUMENTS

| | | | | |
|---|---|---|---|---|
| 7,584,830 | B2 * | 9/2009 | Smith | A47B 85/06 190/11 |
| 7,870,937 | B1 * | 1/2011 | Arnao | A45C 9/00 190/15.1 |
| 8,016,089 | B1 * | 9/2011 | McNichols | A45C 5/14 190/18 R |
| 10,314,375 | B2 * | 6/2019 | Ciraolo | A47D 1/10 |
| 10,473,390 | B2 * | 11/2019 | McCurry | F25D 31/005 |
| 2002/0063072 | A1 * | 5/2002 | Pham | A45C 9/00 206/320 |
| 2004/0226791 | A1 * | 11/2004 | Levy | A45C 9/00 190/11 |
| 2012/0325607 | A1 * | 12/2012 | Webster | A45C 15/00 280/30 |

FOREIGN PATENT DOCUMENTS

| | | | |
|---|---|---|---|
| KR | 1992-0003413 | U | 2/1992 |
| KR | 20-0217999 | Y1 | 3/2001 |
| KR | 10-2013-0069276 | A | 6/2013 |
| KR | 10-2018-0026643 | A | 3/2018 |
| KR | 10-1994413 | B1 | 6/2019 |

* cited by examiner

FREELY-TRANSFORMABLE MULTIPURPOSE CARRIER

FIELD

The present disclosure relates to a multipurpose carrier bag that can be deformed freely, and more particularly, to a freely-transformable multipurpose carrier bag that can be conveniently moved in the form of a carrier bag both indoors and outdoors and irrespective of the size of a place, can be transformed into and used as a table having a chair, can use built-in electronic device components, if needed, so as to enable a user to enjoy various forms of entertainment such as watching TV, using a computer, playing a game, or singing along with music and also to perform a business task, so that the user can universally perform both work and play.

BACKGROUND

In general, it is a well-known fact that a carrier bag is used by many people for convenience in movement and use during business trips at home and abroad or for personal or company business.

However, existing carrier bags have a problem that the bags has only the role of allowing users to safely protect and move his or her items to a predetermined destination with the items kept in the bags, but not being used for other purposes.

In order to solve this problem, the following patent literatures have been published. Patent Literature 1 discloses that a base for placing books or notebooks in a simple carry-on hand bag is placed inside the bag and a foldable crust is attached to the bottom of the bag, so that a user can read books, so that, in the outdoor without a desk or in a classroom, a user can place books to read or place notes to take notes, thereby making sure that the bag does not fall unsafely.

Patent Literature 2 is directed to a travel bag and discloses that the travel bag includes: a bag body which is opened at one side and a receiving space is formed inside; a bag cover fastened to the bag body to cover the receiving space; a support disposed between the bag body and the bag cover and having a variable length such that the size of the space between the bag body and the bag cover is changed; and a divider connected to the support and dividing the space between the bag body and the bag cover.

Patent Literature 3 is directed to a multipurpose bag with a built-in recreation board, which can be used as a bag when folded and as a game board (such as the Go game board and the checkerboard) when unfolded, and discloses that the bag can be divided into two bodies and can be folded 180° around a hinge axis of the both bag bodies with a lid. A partition is installed in the inside of one bag body to allow the recreational equipment to be built in and a rectangular stopper is placed inside the lid of the corresponding body so as to design the GO game board and the checkerboard in front and back, so that the foldable recreation board can be attached and detached using a rubber band. A space portion is provided on the opposite side of the storage compartment of both bag bodies to receive the foldable legs, and the foldable legs are installed to be moved with pins.

However, the related arts are only to be used as a book stand to support books when reading books for the purpose of reducing boredom due to a long travel or when working for business (Patent Literature 1), or to be used as a shelf on the neck to increase the storage of clothes stored in a bag or to store clothes without creases (Patent Literature 2), or to play with a recreation board (Patent Literature 3), and thus, the uses are extremely limited.

Therefore, there is an urgent need for the development of a carrier bag that allows users to use it as a general purpose as well as entertainment by transforming the bag into various uses in addition to the use of the bag.

Related Technical Literature (Patent Literature 0001) Korean Utility Model Publication No. 1984-0002535

(Patent Literature 0002) Korean Patent Application Publication No. 10-2013-0069276

(Patent Literature 0003) Korean Utility Model Publication No. 1992-0003413

SUMMARY

The present disclosure has been developed to address the problems of the related arts and provide various additional advantages, and provides a freely-transformable multipurpose carrier bag that can be conveniently moved in the form of a carrier bag regardless of indoors and outdoors, can be transformed into and used as a table having a chair, can use built-in electronic device components, if needed, so as to enable a user to enjoy various forms of entertainment such as watching TV, using a computer, playing a game, or singing along with music and also to perform a business task, so that the user can universally perform both work and play.

The above object is achieved by a freely-transformable carrier bag provided according to the present disclosure.

In an aspect of the present disclosure, there is provided a multipurpose freely-transformable carrier bag, including: a carrier bag body formed of rectangular first and second receiving enclosures that provide receiving spaces for various components and are coupled in an overlapping state to be separated from each other like a lid; and a handle and a caster installed at the carrier bag body.

The receiving spaces are formed in one sides and the other sides of the first and second receiving enclosures, and foldable supports and a handle are received together in one-side receiving space of the first receiving enclosure so as to allow the foldable support to place the carrier bag body in a horizontal position so that the foldable supports can be deployed from the one-side receiving space of the first receiving enclosure to transform the carrier bag into a table, and the handle is installed to be extendable from the one-side receiving space of the first receiving enclosure and an auxiliary table is installed to be extendable from the one side of the first receiving enclosure, and the foldable chair allowed to be used as a table chair is separately received in one-side receiving space of the second receiving enclosure.

The components are received in other-side receiving spaces of the first receiving enclosure and the second receiving enclosure, respectively, so that when the second receiving enclosure separately coupled to the first receiving enclosure is separated from the first receiving enclosure, the components received to be respectively located in the other-side receiving spaces are exposed to an outside so as to be used for purposes corresponding to the components.

The components constitute a mini PC electrically connected to a power supply installed in the other-side receiving space of the first receiving enclosure, the mini PC which is provided with: a game joy stick; a karaoke wireless microphone; and a multi charger that enables charging of various mobile phones by placing the phones thereon, and the mini PC includes: a flat-panel PC body, which allows a Bluetooth speaker to be placed; a monitor which is installed in a foldable manner to be folded and unfolded from a rear side of the PC body; and a keyboard and a mouse, which are placed on the auxiliary table, and According to separation and coupling of the first and second receiving enclosures for the use of the components, the carrier bag body is capable of being transformed into a variety of forms corresponding to a business or entertainment use.

In another aspect, the power supply includes: an external outlet installed to be exposed to an outside of the other-side receiving space of the first receiving enclosure so as to apply external power; and an internal outlet located inside the other-side receiving space and electrically connected to the external outlet to supply power to each component of the mini PC.

In yet another aspect, the mini PC includes an AI speaker configured to be separable from the first receiving enclosure, and the AI speaker is installed in a state in which the caster is beautifully covered.

Advantageous Effects

According to the present disclosure, a freely-transformable multipurpose carrier bag can be freely moved in the form of a carrier bag regardless of indoors and outdoors, can be transformed into and used as a table having a chair, and can use built-in electronic device components, if needed, so as to enable a user to enjoy various forms of entertainment such as watching TV, using a computer, playing a game, or singing along with music and also to perform a business task, so that the user can universally perform both work and play.

BRIEF DESCRIPTION OF THE DRAWINGS

FIG. 2(*b*) is an exploded perspective view showing the right interior of FIG. 1.

DETAILED DESCRIPTION

Figure 1:
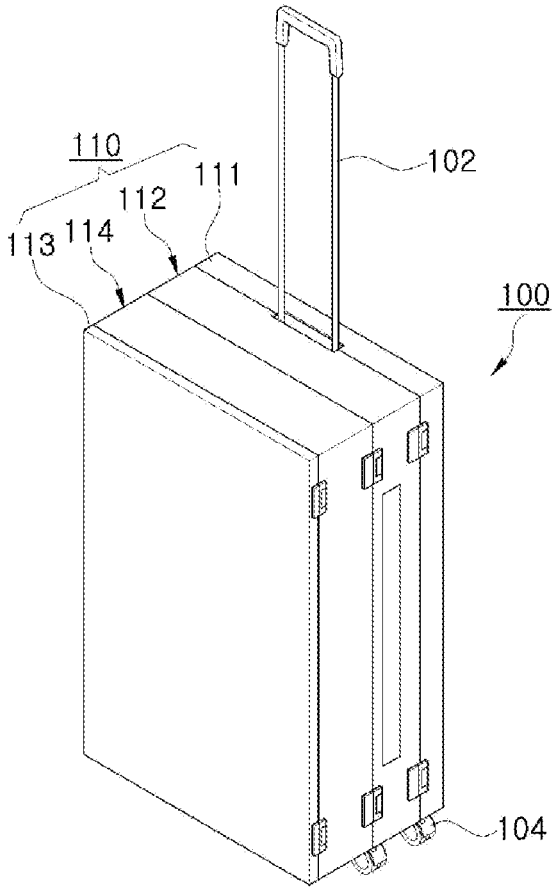
FIG. 1 is a perspective view showing an example of the appearance of a freely-transformable multipurpose carrier bag according to the present disclosure.

As the present disclosure allows for various changes and numerous embodiments, particular embodiments will be illustrated in the drawings and described in detail in the written description.

However, this is not intended to limit the present disclosure to particular modes of practice, and it is to be appreciated that all changes, equivalents, and substitutes that do not depart from the spirit and technical scope of the present disclosure are encompassed in the present disclosure.

In addition, in describing the present disclosure, certain detailed explanations of related art are omitted, when it is deemed that they may unnecessarily obscure the essence of the present disclosure. Further, terms to be described later are terms defined in consideration of functions of the present disclosure, and these may vary with the intention or practice of a user or an operator, and therefore, such terms should be defined based on the entire content disclosed herein.

Hereinafter, a more preferred embodiment of a freely-transformable multipurpose carrier bag according to the present disclosure will be described in detail with reference to the accompanying drawings.

FIG. 1 is a perspective view showing an example of the appearance of a freely-transformable multipurpose carrier bag according to the present disclosure.

As shown in the drawing, a freely-transformable multipurpose carrier bag 100 according to the present disclosure includes a carrier bag body 110 having an extendable handle 102 and a caster 104, the carrier bag body 110 in which rectangular first and second receiving enclosures 112 and 114 providing receiving spaces for various components are separately combined with a plurality of first and second lids 111 and 113 in an overlapping state, so that according to the separation and coupling of the first and second receiving enclosures 112 and 114 for the use of the components, the carrier bag body 110 can be easily carried and moved anywhere outside such as business trips, travel, and moving as well as in a narrow indoor space and can be transformed into a variety of forms corresponding to business or entertainment use.

As shown in the drawing, the size or shape of the carrier bag 100 according to the present disclosure may be arbitrarily modified according to the size and number of the first and second receiving enclosures 112 and 114.

In addition, the carrier bag 100 may be formed of high-strength lightweight metal or of high-strength and corrosion-resistant and flame-resistant plastic to prevent damage or cracks caused by an external impact.

Figure 2A:
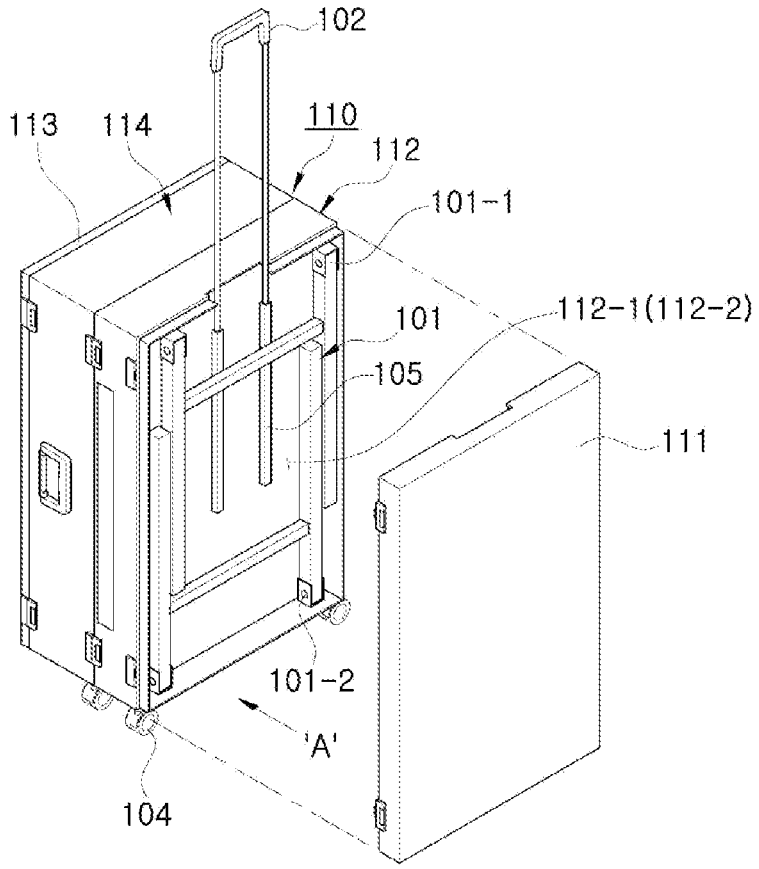
FIGS. 2(*a*) is an exploded perspective views showing the left interior of FIG. 1.
Figure 2B:
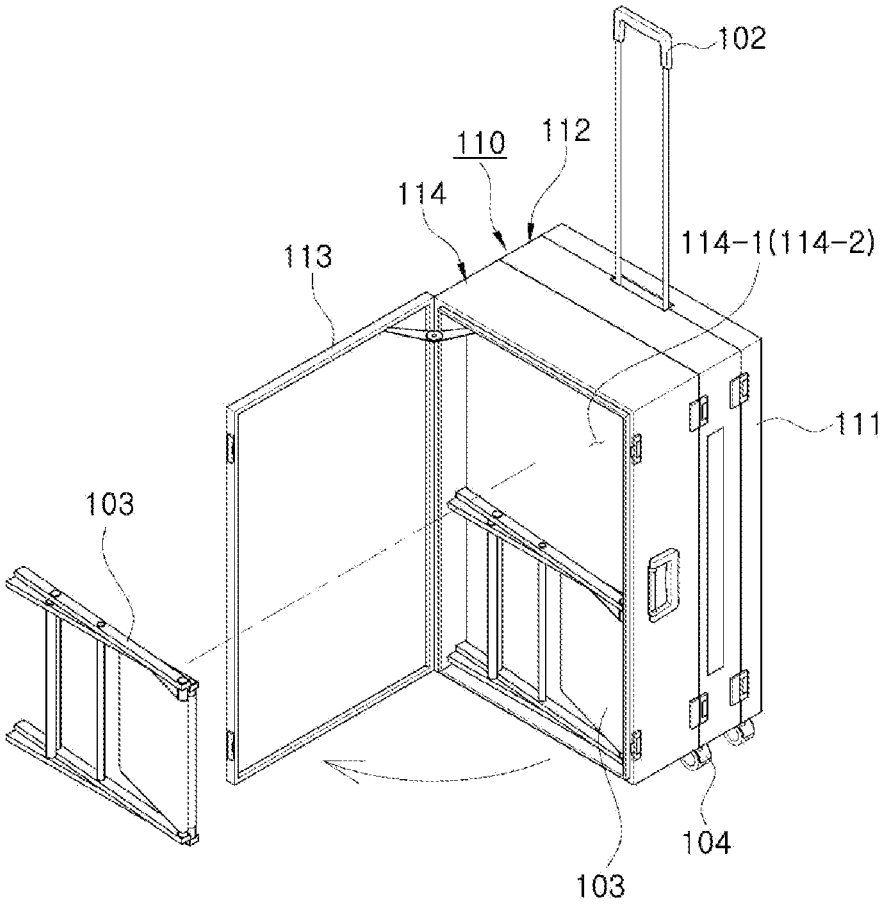
Figure 3:
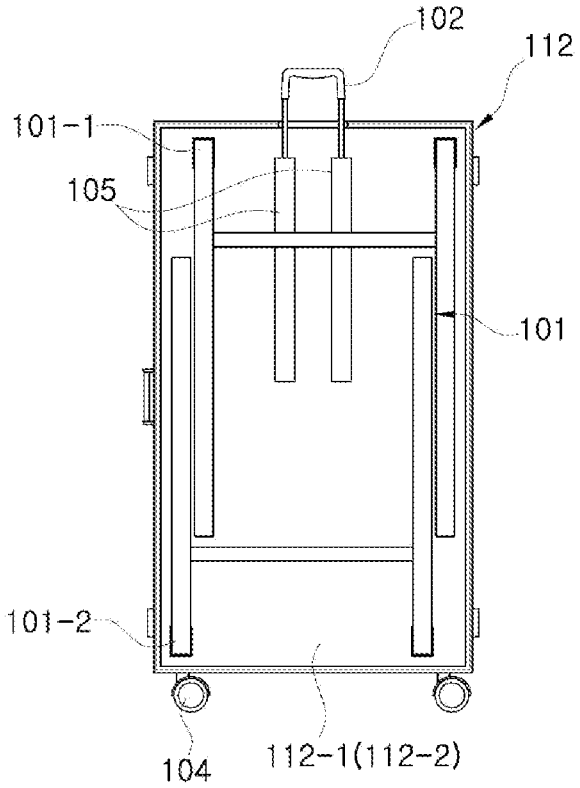
FIG. 3 is a view showing FIG. 2(*a*) viewed from the direction of arrow "A".

FIGS. 2(*a*) and 2(*b*) are exploded perspective views showing the left and right interiors of FIG. 1, respectively, and FIG. 3 is a view showing FIG. 2(*a*) viewed from the direction of arrow "A".

As shown in the drawing, in the first and second receiving enclosures 112 and 114 of the carrier bag 100 according to the present disclosure, a plurality of receiving spaces 112-1, 112-2, 114-1, and 114-2 (see FIGS. 5 and 6), which allow corresponding components to be received freely, are formed in an open state, two at each side, The first and second lids 111 and 113 are separately coupled to the openings of one-side receiving spaces 112-1 and 114-1 of the first and second receiving enclosures 112 and 114 so as to close the one-side receiving space 112-1 and 114-1, so that the components received in the one-side receiving spaces 112-1 and 114-1 cannot be easily removed to the outside.

Figure 7:
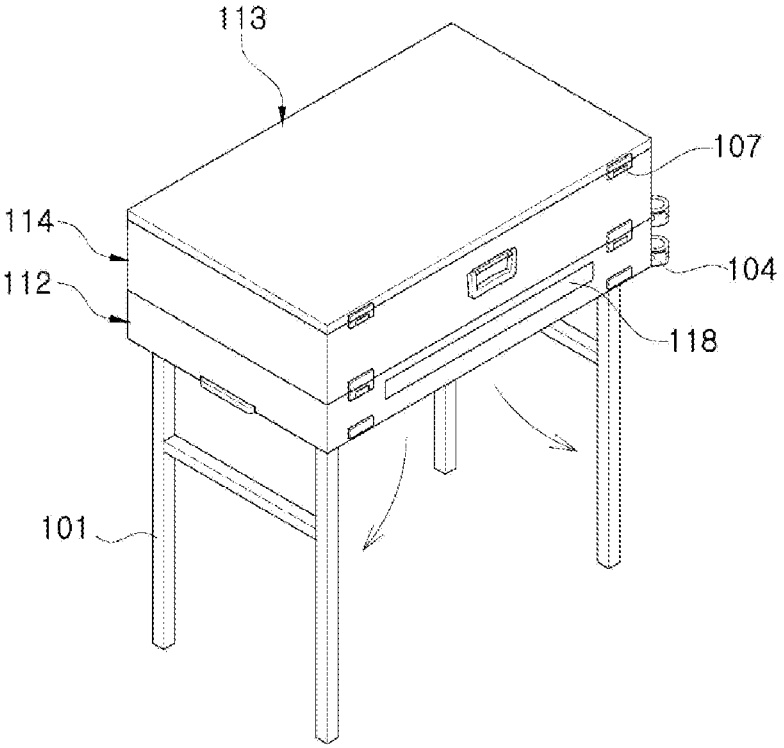
FIG. 7 is a view showing a state in which the carrier bag of FIG. 1 according to the present disclosure is transformed into a table.

In the one-side receiving space 112-1 that is separately closed by the first lid 111 of the first receiving enclosure 112, the foldable support 101 is received to be folded using hinge portions 101-1 and 101-2 as support points, so that, if necessary, in a state in which the first lid 111 is opened, the support 101 can be rotated to be deployed in a vertically standing state using the hinge portions 101-1 and 101-2 as support points, In the case of receiving, the foldable support 101 may be rotated to be folded in the opposite direction to be received into the inside of the one-side receiving space 112-1 in the states shown in FIG. 2A and FIG. 3, The installation of the folding support 101 into the inside of the one-side receiving space 112-1 is to transform the carrier bag 100 according to the present disclosure into a table for work or for entertainment, and this will be described later with reference to FIG. 7.

As shown in the drawing, In the second receiving enclosure 114 that is separately coupled to the first receiving enclosure 112 in an overlapping state, a general foldable chair 103 is received within the one-side receiving space 114-1 separately closed by the second lid 113, so that the foldable chair 103 can be easily taken out, In the case of transforming the carrier bag 100 according to the present disclosure into a table for work or entertainment by developing the folding support 101 from the one-side receiving space 112-1 of the first receiving enclosure 112, the foldable chair 103 may be taken out by opening the second lid 113 from the one-side receiving space 114-1 of the second receiving enclosure 114, and after the foldable chair 103 is taken out, the second lid 113 is preferably closed in its original state and used, Since the foldable chair 103 is a conventional chair, a detailed description thereof will be omitted in this embodiment.

As shown in the drawing, in the one-side receiving space 112-1 of the first receiving enclosure 112 in which the folding support 101 is received to be deployed, the handle 102 is slidably received in a guide bar 105 separately from the folding support 101 in a way to be installed in an extendable manner from the one-side receiving space 112-1 so that there is no mutual interference with the folding support 101 when used.

Figure 4:
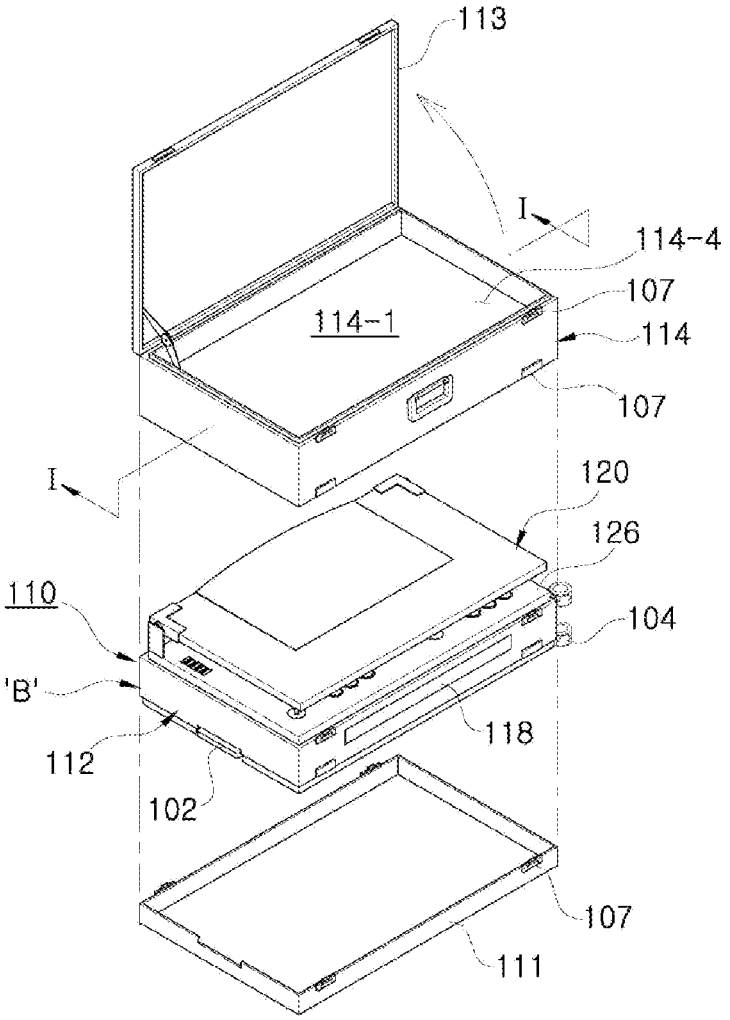
FIG. 4 is an exploded perspective view showing each component separated and displayed in a state in which the right part is positioned downward in FIG. 1.
Figure 5:
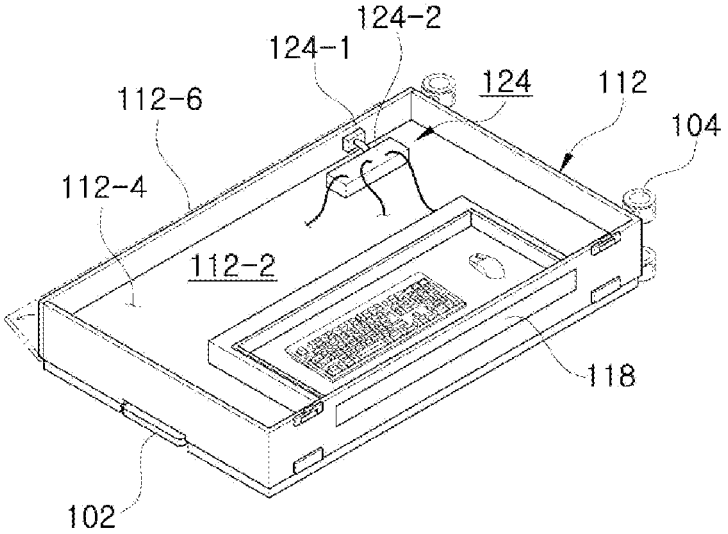
FIG. 5 is a view showing the interior by separating only the "B" part in FIG. 4.
Figure 6:
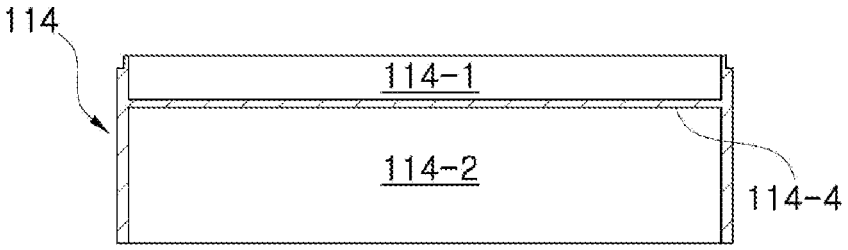
FIG. 6 is a cross-sectional view taken along line I-I of FIG. 4.

FIG. 4 is an exploded perspective view showing all components being separated with the right part positioned downward in FIG. 1, and FIG. 5 is a view showing the inside by separating only the "B" part in FIG. 4, and FIG. 6 is a cross-sectional view taken along line I-I of FIG. 4.

As shown in the drawing, the receiving spaces 112-1, 112-2, 114-1 and 114-2 provided in the first and second receiving enclosures 112 and 114 of the carrier bag 100 according to the present disclosure are formed in both sides by partition plates 112-4 and 114-4 installed in the second receiving enclosures 112 and 114.

FIG. 6 shows that the inside of the second receiving enclosure 114 is formed with the receiving spaces 114-1 and 114-2 on both sides by the partition plates 114-4 and 114-2, and the first receiving enclosure 112 is also configured such that the receiving spaces 112-1 and 112-2 are formed by the partition plates 112-4 installed in the first receiving enclosure 112, and thus, a detailed description of the configuration is omitted.

When other-side receiving spaces 112-2 and 114-2 formed in the first and second receiving enclosures 112 and 114, respectively, are coupled in a state in which the first and second receiving enclosures 112 and 114 face each other to overlap each other, the other-side receiving spaces 112-2 and 114-2 meet each other and form a larger receiving space so that components 120 can be received, In the case of separating the second receiving enclosure 114 separately coupled to the first receiving enclosure 112, the components 120 may be exposed to the outside so that the components 120 can be used for purposes thereof.

As shown in the drawing, the coupling of the first and second receiving enclosures 112 and 114 and the coupling of the first and second receiving enclosures 112 and 114 and the first and second lids 111 and 113 may be separately coupled by installing a locking member 107, such as a general clamp, in order not to be easily opened during transportation or movement.

Figure 8:
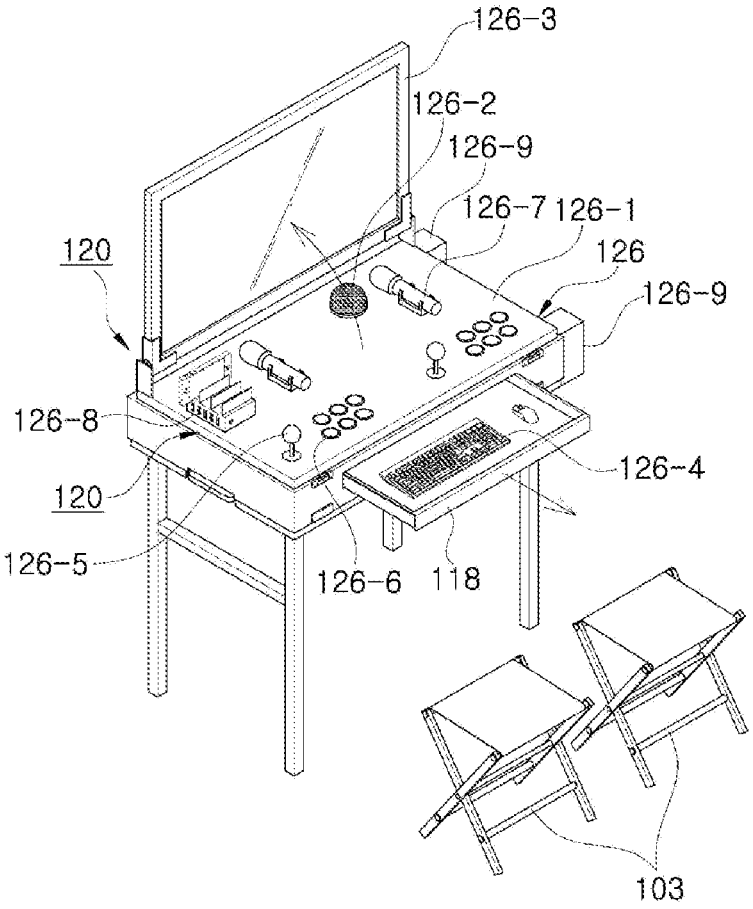
FIG. 8 is a view showing that the carrier bag of FIG. 1 according to the present disclosure is transformed from the table of FIG. 5 into a form which can enable a user to enjoy various forms of entertainment such as watching TV, using a computer, playing a game, or singing along with music and also to perform a business task.

The components 120 received in the other-side receiving spaces 112-2 and 114-[0041] 2 formed in the first and second receiving enclosures 112 and 114, respectively, constitute a mini PC 126 that is electrically connected to a power supply 124 installed in the other-side receiving space 112-2 of the first receiving enclosure 112, and, as shown in FIG. 8 which will be described later, this mini PC 126 includes: a flat-panel PC body 126-1 that allows a Bluetooth speaker 126-2 to be placed; a monitor 126-3 installed in a foldable manner to be folded and unfolded from a rear side of the PC body 126-1; and a keyboard 126-4 and a mouse (not shown), which are placed on an auxiliary table 118 installed in an extendable manner from the first receiving enclosure 112.

In addition, as shown in FIG. 8 to be described later, the mini PC 126 is provided with a game joy stick 126-5 and a game button 126-6, a karaoke wireless microphone 126-7, and a multi charger 126-8 that enables charging of various mobile phones by placing the phones thereon, and the mini PC 126 is provided with an AI speaker 126-9 configured to be separable from the first receiving enclosure 112, and in the case of transforming the carrier bag 100 according to the present disclosure, the AI speaker 126-9 may be installed and used in a state in which the caster 104 attached to the first receiving enclosure 112 are beautifully covered.

As shown in the drawing, the power supply 124 includes an external outlet 124-1 installed to be exposed to the outside of the other-side receiving space 112-2 of the first receiving enclosure 112 so as to apply external power, and an internal outlet 124-2 located inside the other-side receiving space 112-2 and electrically connected to the external outlet 124-1 to supply power to each component of the mini PC 126, and a rear wall plate 112-6 of the first receiving enclosure 112 may be configured to be opened and closed in a casement shape for maintenance of the power supply 124.

An example of the operation of the present disclosure having such a configuration will be described with reference to FIGS. 7 and 8 together with the above-described drawings.

FIG. 7 is a diagram showing a state in which the carrier bag of FIG. 1 according to the present disclosure is transformed into a table, and FIG. 8 is a view showing the carrier bag of FIG. 1 according to the present disclosure from the table of FIG. 7 into a form which can enable a user to enjoy various forms of entertainment such as watching TV, using a computer, playing a game, or singing along with music and also to perform a business task.

As shown in the drawing, the present disclosure separately couples the first and second lids 111 and 113 in an overlapping manner with the first and second receiving enclosures 112 and 114 having the plurality of receiving spaces 112-1, 112-2, 114-1, and 114-2 capable of freely receiving components, thereby forming the carrier bag 100 easy to carry, and hence, it is possible to freely carry the carrier bag 100 using a caster 105 or the handle 102 to a destination such as a large or narrow indoor space like a hotel room, a studio, a residence, or a home house or any outdoor space.

<When Transformed into Table>

For example, as shown in FIG. 7, in the case of transforming the carrier bag 100 according to the present disclosure into a table for work or other personal work, when the first lid 111 is completely separated from the first receiving enclosure 112 and then the folding support 101, which was received in the one-side receiving space 112-1 exposed to the outside from the first receiving enclosure 112, is rotated to be deployed in a state vertically erected using the hinge portions 101-1 and 101-2 as a support point, so that the folding support 101 is supported toward the bottom, the carrier bag body 110 is supported in a horizontal position by a folding support 101 so that the carrier bag body 110 can be used as a table for work or entertainment.

When the carrier bag body 110 is used as a table, it is preferable that the handle 102 is received in the first receiving enclosure 112.

The foldable chair 103 received in the second receiving enclosure 114 may be taken out by opening the second lid 113 and then used as a chair, and it is preferable that after the foldable chair 103 is taken out, the second lid 113 is coupled to the second receiving enclosure 114 so that there is no inconvenience in using the table.

<When Used as Mini PC>

In the state of FIG. 7, when the second receiving enclosure 114 is separated from the first receiving enclosure 112 like the second lid 113, the mini PC 126 consisting of the components 120 received in the other-side receiving spaces 112-2 and 114-2 of the first and second receiving enclosures 112 and 114 may be completely exposed to the outside in a state in which the mini PC 126 is received in the other-side receiving space 112-2 of the first receiving enclosure 112.

Therefore, if the monitor 126-3, which has been folded so far, is erected to be easily seen from the other-side receiving space 112-2 of the first receiving enclosure 112 and the power is applied from the power supply 124 to cause an ON state, a desired task may be freely performed by using the keyboard 126-4 connected to the PC body 126-1 and placed on the auxiliary table 118 or by using a wireless mouse.

<When Used as Game Device>

If users use the carrier bag 100 as a game device, the carrier bag 100 may be connected to an entertainment game program pre-installed in the mini PC 126 or an Internet game, so that the users can enjoy a game using the joy stick 126-5 and the manipulation button 126-6 while listening to enriched sound from the Bluetooth speaker 126-2.

<When Used as Karaoke Device>

When the carrier bag 100 is used as a karaoke device, a user may sing various songs using the wireless microphone 126-7 while watching a video output from the 32-inch UHD monitor 126-3, and enriched sound may be output through a built-in speaker or the Bluetooth speaker 126-2 or music may be output through the AI speaker 126-9.

<When Watching TV>

Using the 32-inch UHD monitor 126-3, it is possible to watch terrestrial or cable TV with high image quality.

In addition, it is practical that various mobile phones and note phones including iPhones are charged using the multi-charger 126-8 installed in the PC body 126-1 of the mini PC 126, while working or playing.

As described above, there is an advantage in that one carrier bag has various functions so that the bag can be used in various ways for work or entertainment in a predetermined place.

When moving after the use described above, the foldable chair 104 or the monitor 126-3 is again folded to be received into the one-side receiving space 112-1 and the other-side receiving space 112-2 of the first receiving enclosure 112, the foldable chair 103 or the AI speaker 126-9 is stably received into the one-side receiving space 114-1 again, the first and second receiving enclosures 112 and 114 and the first and second lids 111 and 113 are closed and coupled to the locking member 107 to form the carrier bag 100, and the handle 102 is taken out as shown in FIG. 1 to move to a desired destination, which is convenient.

What is claimed is:

1. A freely-transformable multipurpose carrier bag, comprising:

a carrier bag body formed of rectangular first and second receiving enclosures that provide receiving spaces for various components and are coupled in an overlapping state to be separated from each other like a lid; and a handle and a caster installed at the carrier bag body, wherein the receiving spaces are formed in one sides and the other sides of the first and second receiving enclosures, wherein foldable supports and a handle are received together in one-side receiving space of the first receiving enclosure so as to allow the foldable support to place the carrier bag body in a horizontal position so that the foldable supports can be deployed from the one-side receiving space of the first receiving enclosure to transform the carrier bag into a table, wherein the handle is installed to be extendable from the one-side receiving space of the first receiving enclosure and an auxiliary table is installed to be extendable from the one side of the first receiving enclosure, wherein the foldable chair allowed to be used as a table chair is separately received in one-side receiving space of the second receiving enclosure, wherein the components are received in the other-side receiving spaces of the first receiving enclosure and the second receiving enclosure, respectively, so that when the second receiving enclosure separately coupled to the first receiving enclosure is separated from the first receiving enclosure, the components received to be respectively located in the other-side receiving spaces are exposed to an outside so as to be used for purposes corresponding to the components, wherein the components constitute a mini PC electrically connected to a power supply installed in the other-side receiving space of the first receiving enclosure, the mini PC which is provided with: a game joy stick; a karaoke wireless microphone; and a multi charger that enables charging of various mobile phones by placing the phones thereon, wherein the mini PC comprises: a flat-panel PC body which allows a Bluetooth speaker to be placed; a monitor which is installed in a foldable manner to be folded and unfolded from a rear side of the PC body; and a keyboard and a mouse, which are placed on the auxiliary table, and wherein according to separation and coupling of the first and second receiving enclosures for the use of the components, the carrier bag body is capable of being transformed into a variety of forms corresponding to a business or entertainment use.

2. The freely-transformable multipurpose carrier bag of claim 1, wherein the power supply comprises:

an external outlet installed to be exposed to an outside of the other-side receiving space of the first receiving enclosure so as to apply external power; and an internal outlet located inside the other-side receiving space and electrically connected to the external outlet to supply power to each component of the mini PC, and wherein a rear wall plate of the first receiving enclosure is configured to be opened and closed in a casement shape for maintenance of the power supply.

* * * * *